US008561311B1

(12) United States Patent
Richards

(10) Patent No.: US 8,561,311 B1
(45) Date of Patent: Oct. 22, 2013

(54) APPARATUS FOR MEASURING AND CUTTING TREADS

(76) Inventor: Lee E. Richards, Whitefield, ME (US)

( * ) Notice: Subject to any disclaimer, the term of this patent is extended or adjusted under 35 U.S.C. 154(b) by 160 days.

(21) Appl. No.: 13/349,828

(22) Filed: Jan. 13, 2012

Related U.S. Application Data

(60) Provisional application No. 61/471,295, filed on Apr. 4, 2011.

(51) Int. Cl.
*B43L 13/02* (2006.01)

(52) U.S. Cl.
USPC ..... 33/527; 33/42

(58) Field of Classification Search
USPC ..... 33/526, 527, 42, 562, 452, 415, 418, 33/419, 423, 430, 438, 441, 443, 446, 464, 33/474, 534, 501, 613, 645
See application file for complete search history.

(56) References Cited

U.S. PATENT DOCUMENTS

| | | | | |
|---|---|---|---|---|
| 3,242,580 | A * | 3/1966 | Crawford | 33/562 |
| 3,888,477 | A * | 6/1975 | Tate | 33/613 |
| 5,461,798 | A * | 10/1995 | Ribeiro | 33/562 |
| 6,748,668 | B2 * | 6/2004 | Huff | 33/562 |
| 7,010,861 | B2 * | 3/2006 | Nicholson | 33/42 |
| 2005/0283986 | A1 * | 12/2005 | Nicholson | 33/42 |
| 2012/0285028 | A1 * | 11/2012 | Atwood | 33/452 |
| 2012/0311880 | A1 * | 12/2012 | Doggett | 33/452 |

* cited by examiner

*Primary Examiner* — Yaritza Guadalupe-McCall
(74) *Attorney, Agent, or Firm* — Patricia M. Mathers

(57) ABSTRACT

The invention is an apparatus for accurately measuring and cutting a stair tread. The apparatus has an length-adjustable bar to determine the width of a step and, at each end of the bar, sidewall adjustment assemblies that are pressed up against the sidewall and tightened into place. The sidewall assemblies have two or more movably coupled plates that accommodate out-of-square condition of a sidewall. A noseplate assembly on the front of the sidewall adjustment assembly allows an adjustment to accommodate the thickness of the tread material.

14 Claims, 13 Drawing Sheets

APPARATUS FOR MEASURING AND CUTTING TREADS

BACKGROUND INFORMATION

1. Field of the Invention

The invention relates to the field of measuring and cutting apparatus. More particularly, the invention relates to apparatus for measuring and cutting a tread.

2. Discussion of the Prior Art

Stairs are frequently covered with a material, to protect the wood, for aesthetic reasons, or to provide a non-slip or wear-resistant covering. In commercial buildings stair treads are frequently used to cover the steps, because they are replaceable as needed and increase the durability of the step. Professional installation of treads, however, entails carefully measuring each individual tread in order to obtain precise dimensions and then transferring the dimensions to the material be cut, in order to fit each step with a custom-cut tread. The reason that each step must be measured individually is that the tread should cover the top portion of the step and fit flush against the staircase sidewalls, but the sidewalls are frequently not precisely square relative to the side edge of the step. The process of installing treads in this manner is time-consuming and often results in less than ideal results, because the installer has not been able to accommodate the out-of-square construction.

Numerous devices are available to aid the installer in obtaining the dimensions of the step to be covered. A disadvantage of these aids is that they do not accommodate staircase sidewalls that are not aligned squarely relative to the surface of the tread. The sidewalls may be at a slight angle, or worse, the sidewalls may have slight curve to them. Most of the conventional aids assume that the sidewalls are square. Some aids provide some accommodation of a sidewall that has a perfectly flat surface, but is at a slight angle relative to the edge of the step. None of them measures the precise perimeter of the step.

An installer, either using any of the conventional aids available today or measuring by hand, will fail to accurately measure the entire perimeter of the step. The cut tread frequently doesn't fit the step precisely. If the problem is that the tread material buckles, some excess material may be removed. But if the tread leaves a gap along a portion of the edge to the sidewall, that problem cannot be easily fixed. The gap is unsightly, and often not acceptable to the owner of the residence. As a result, the installer ends up cutting filler pieces or a new tread.

Measuring the dimensions of the tread is difficult enough, but transferring the dimensions to the tread material and then cutting the tread opens up further possibilities for introducing errors.

What is needed, therefore, is measuring and cutting apparatus to aid in measuring, transferring measurements, and cutting a tread. What is yet further needed is such an apparatus that accurately measures the dimensions of the step, including out-of-square configurations. What is still yet further needed is such an apparatus that transfers the dimensions to the tread material and provides a guide for cutting the material.

BRIEF SUMMARY OF THE INVENTION

The invention is an apparatus for accurately measuring, marking, and/or cutting the shape of a tread that is then to be cut from tread material. The term "tread" is used in the field to refer to two different things, the top portion of a step in a stair case, and to material that is used to cover the top portion of the step. To avoid confusion in identifying the these two separate entities, the following definitions shall be used hereinafter: "tread" and "tread" shall refer to material that has been or is in the process of being cut to cover a step in a staircase. "Step" shall be used to refer to the top portion, i.e., the tread, of a step in a staircase.

One of the difficulties of accurately measuring treads is that the sidewalls of the staircase are not exactly orthogonal to the side edge of the step. In other words, the sidewalls may be out-of-square with the side edge. Conventional measuring systems cannot accommodate this "out-of-squareness", and, consequently, the treads that are measured and then cut often do not fit flush against the sidewall. If the sidewall bows out slightly, there will be a gap between the end of the cut tread and the sidewall and, conversely, if it bows in slightly, the tread will not lie flat, but instead, will bulge up. This buckling or gapping is unsightly and perceived as poor workmanship in the trade.

The apparatus according to the invention has an adjustable-length frame, with adjustment assemblies on each end. These adjustment assemblies include several plates that are movable relative each other, which allows the plates to more accurately follow the contour of the sidewall and the nosing, which is the front edge of the tread that meets or overhangs the riser of the previous step. To use the apparatus, an installer lays the frame on the step and extends it out, so that the adjustment assemblies bump up against the sidewalls and the nose plates assemblies bump up against the leading edge of the step, and locks the frame in place. The adjustment assemblies are then pushed flush up against the sidewalls and locked into position. The nose plate assemblies have a recess for receiving a thickness gauge, which is typically a strip of the tread material, so that, by placing the strip of the material in the nose plate assembly and pushing the nose plate flush against the leading edge, the apparatus takes into account the thickness of the tread material, when obtaining the measurements of the step.

Once all the plates have been locked into position, the installer then notes the dimension on the tape measure provided on the frame, releases the frame lock and slides the frame extension bar in to a shorter length, so that the apparatus may be lifted from the step, without interference from the sidewalls. The installer can then move the apparatus to a cutting table, remove the thickness gauges from the noseplate assemblies, place the apparatus on top of the tread material on the table, extend the frame extension bar to the previously noted dimension, and then cut along the sidewall adjustment assemblies. A simple straight edge is used to cut along the back edge, where the tread meets the riser.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figures 1, 2:
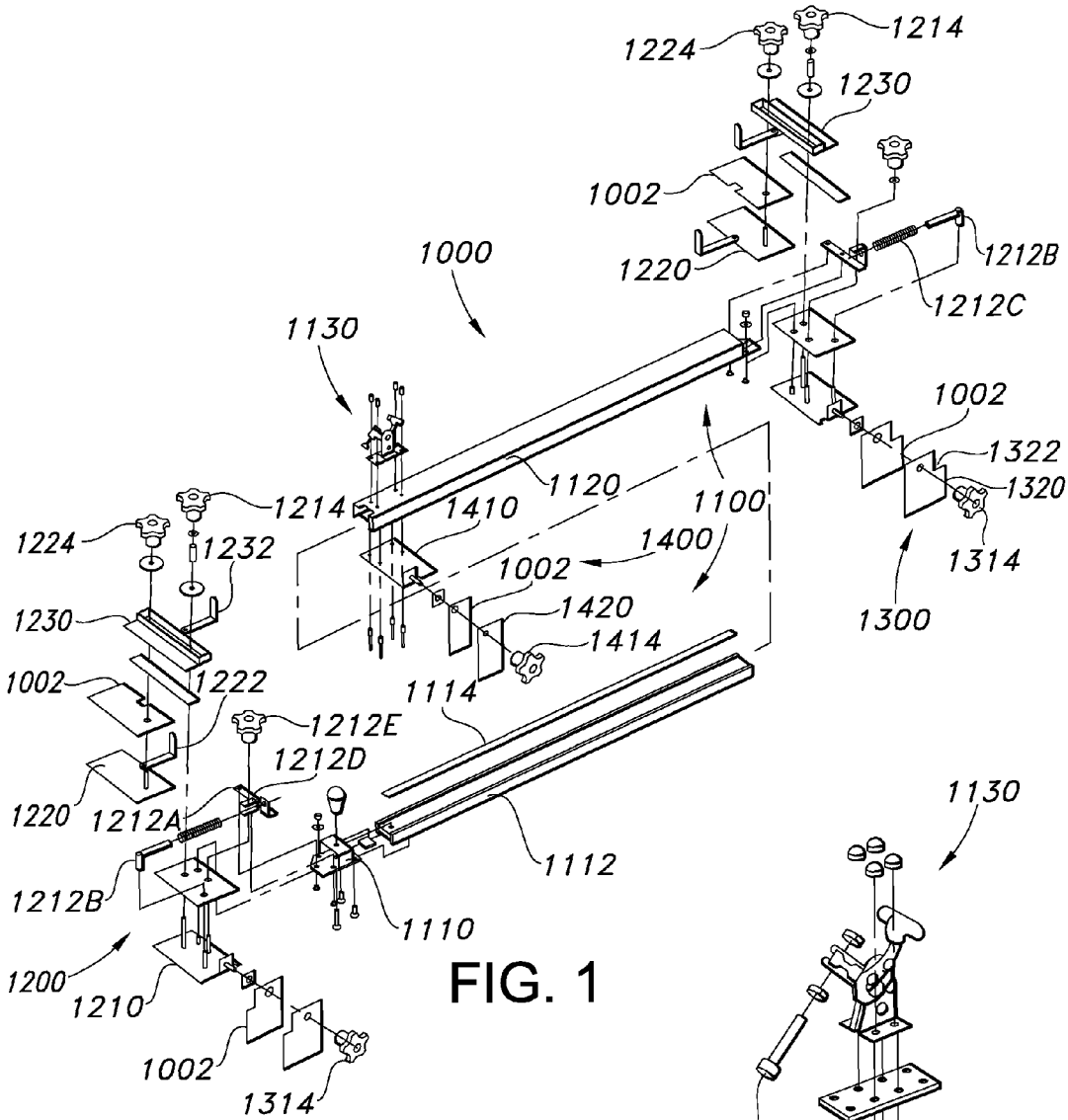
FIG. 1 is an exploded illustration of the apparatus according to the invention for measuring, marking, or using as a cutting guide on treads.
FIG. 2 is an exploded view of the frame lock assembly.
Figure 3:
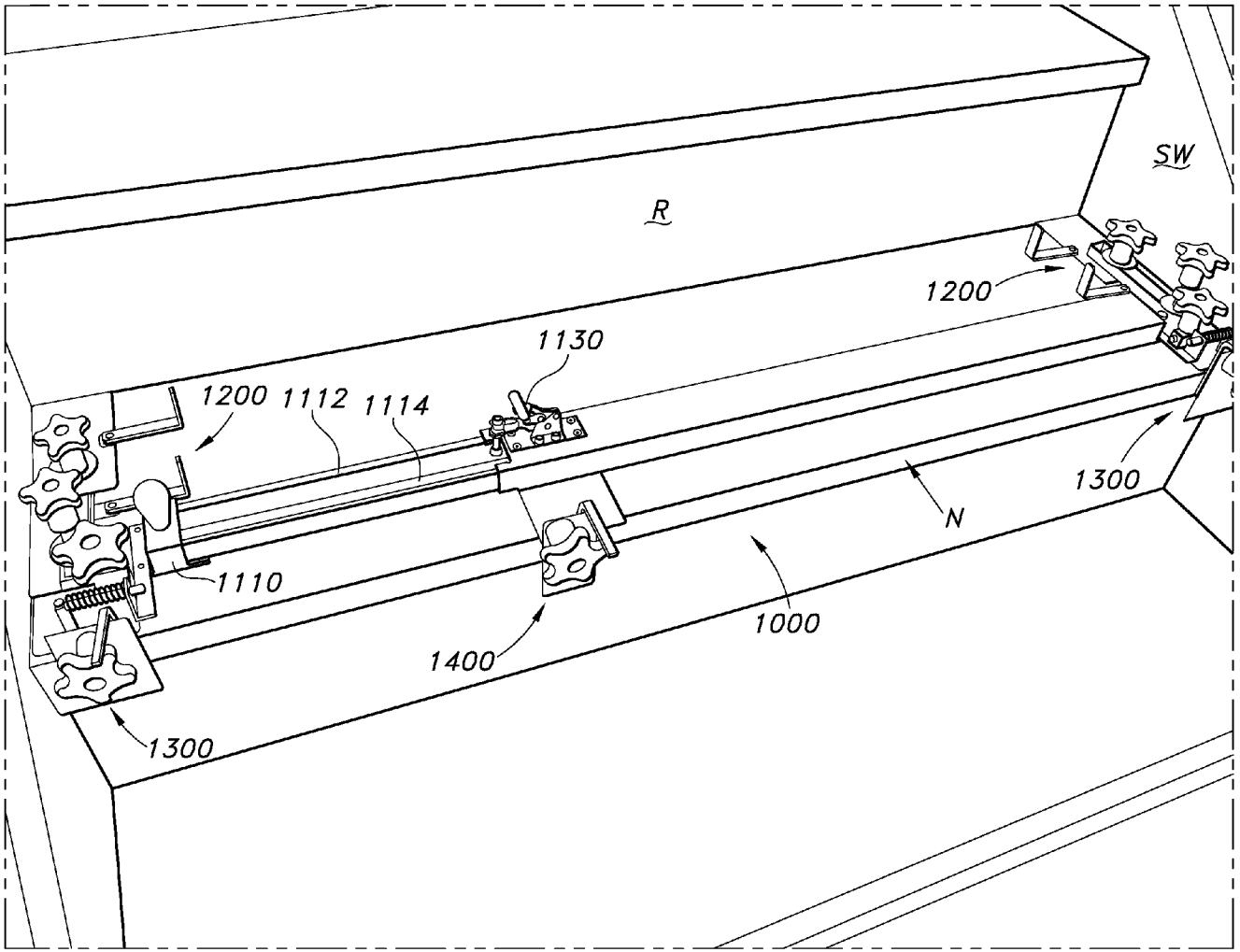
FIG. 3 is a perspective view of the apparatus of FIG. 1, locked into position on a step.

FIGS. 1 and 2 are exploded views of apparatus 1000 for accurately recording the shape of a tread to be cut from tread material. FIG. 3 shows the apparatus 1000 fitted into position on a step. The apparatus 1000 comprises a length-adjustable frame 1100, at least one sidewall adjustment assembly 1200, and at least one noseplate assembly 1300. The embodiment illustrated in these figures has a sidewall adjustment assembly 1200 at each end of the frame and a noseplate assembly 1300 at each sidewall adjustment assembly. These two sidewall adjustment assemblies 1200 and noseplate assemblies 1300 are mirror-reverse symmetrical to each other, that is, one is constructed to measure a right sidewall and one to measure a left sidewall, and, therefore, only one will be described in detail.

Still referring to FIG. 1, the extension frame 1100 has a fixed frame end 1110 that includes a slider base 1112, and an extension bar 1120 that is slidable along the slider base 1112. A measurement means 1114 is provided on the slider base. The measurement means 1114 may be a tape measure affixed to the base or a series of markings made directly on the base. A frame lock 1130 is provided on the inner end of the extension bar 1120, which serves to lock the bar to a desired length. Various types of locking or clamping mechanisms may be used for this purpose. In the embodiment shown, the frame lock 1130 is a clamp that snaps to the lock position. The bottom end of the clamp is fitted with some type of anti-slip means 1132 to provide greater friction force against the slider base 1112. A center noseplate assembly 1400 is affixed to the extension bar 1120.

Figure 4:
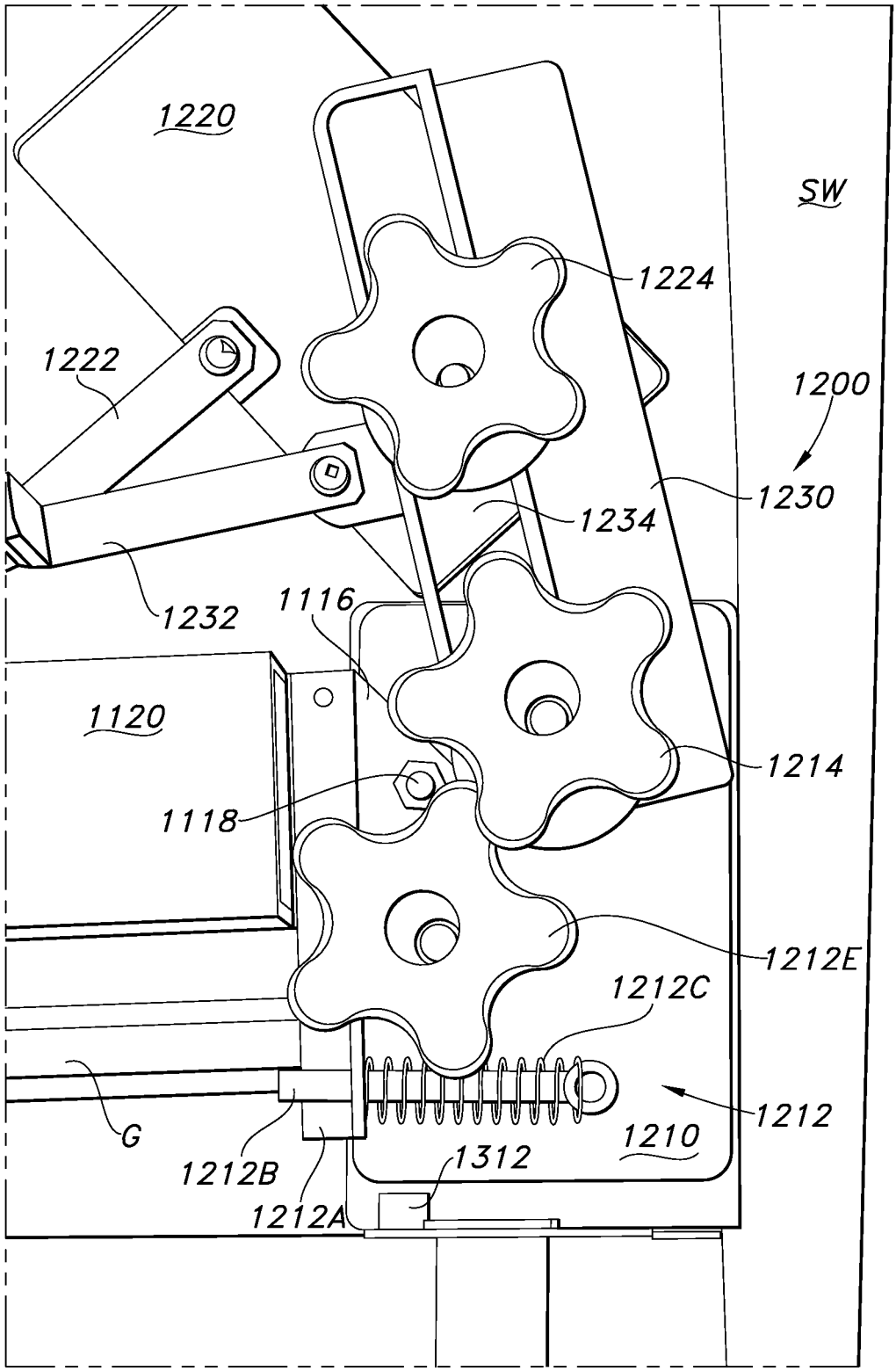
FIG. 4 is a top plan view of a sidewall adjustment assembly.
Figure 4A:
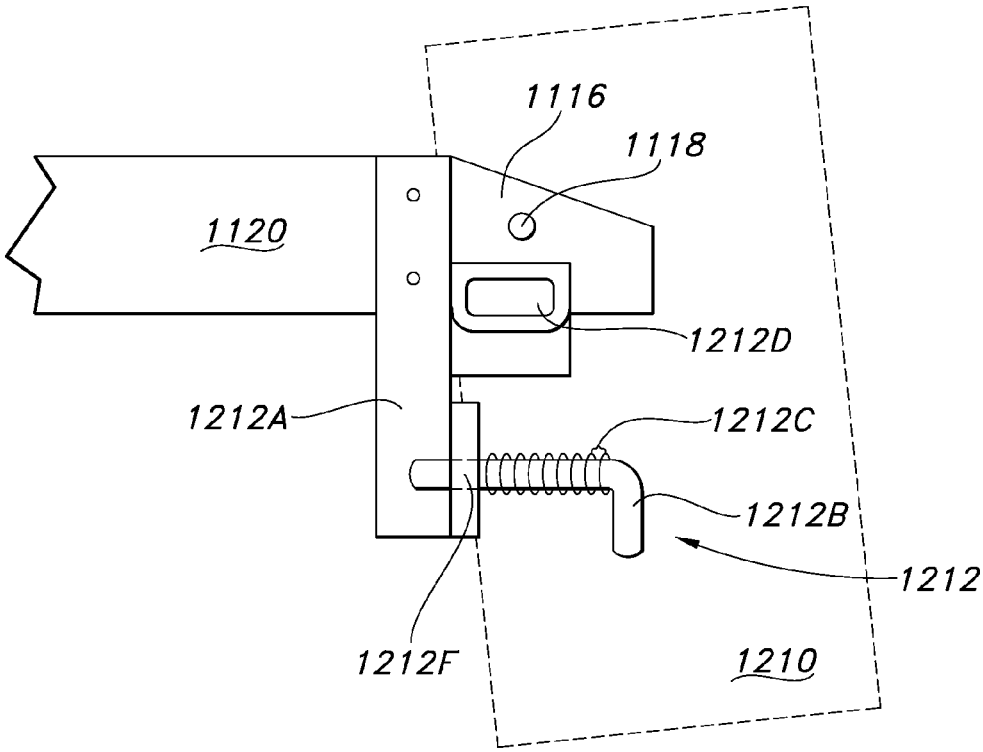
FIG. 4A is a perspective view of the biasing assembly.
Figure 4B:
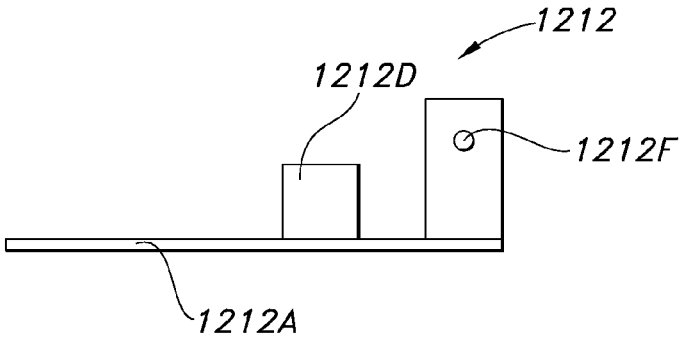
FIG. 4B is a side elevation view of the biasing assembly, showing the adjustment slot and retainer for the biasing spring pivot pin.

FIG. 4 is an illustration of the sidewall adjustment assembly 1200 that is in the process of being fitted up against a sidewall SW. In the embodiment shown, the sidewall adjustment assembly 1200 comprises a first plate 1210, a second plate 1220, and a tread-depth adjustment plate 1230 that couples the first and second plates together. Each of these plates 1210, 1220, and 1230 has an outer edge that is adjustable to capture the contour of the sidewall. The first plate 1210 is affixed to a tongue 1116 at the end of the extension bar 1120, such that the plate 1210 may rotate about a pivot point 1118 on the tongue 1116. Also affixed to the tongue 1116 is a spring biasing assembly 1212, which serves to bias the front end of the first plate 1210 outward toward the sidewall and also serves to eliminate all slack or drift when tightening the first plate 1210 and the tread-depth adjustment plate 1230. The biasing assembly 1212 comprises a bar 1212A that is rigidly affixed to the tongue 1116. FIGS. 4A and 4B are schematic illustrations that show details of the biasing assembly 1212. An adjustment slot 1212D is provided on the bar 1212A and a fastening means 1212E, shown in FIG. 4, which is movable within the adjustment slot 1212D, couples the first plate 1210 with the bar 1212A. In the embodiment shown, the fastening means is a five-point star knob mounted on a threaded shaft that is anchored on the first plate 1210. The first plate 1210 may be locked into position by tightening the fastening means 1212E. A biasing spring 1212C is provided on a spring pivot pin 1212B that is affixed at one end to the first plate 1210 and is freely movable through an aperture 1212F provided on the bar 1212A. Depending on the specific angle of the sidewall SW to the longitudinal axis of the frame 1100, the spring pivot pin 1212B will extend to a greater or lesser extent through the aperture 1212F.

Figure 5:
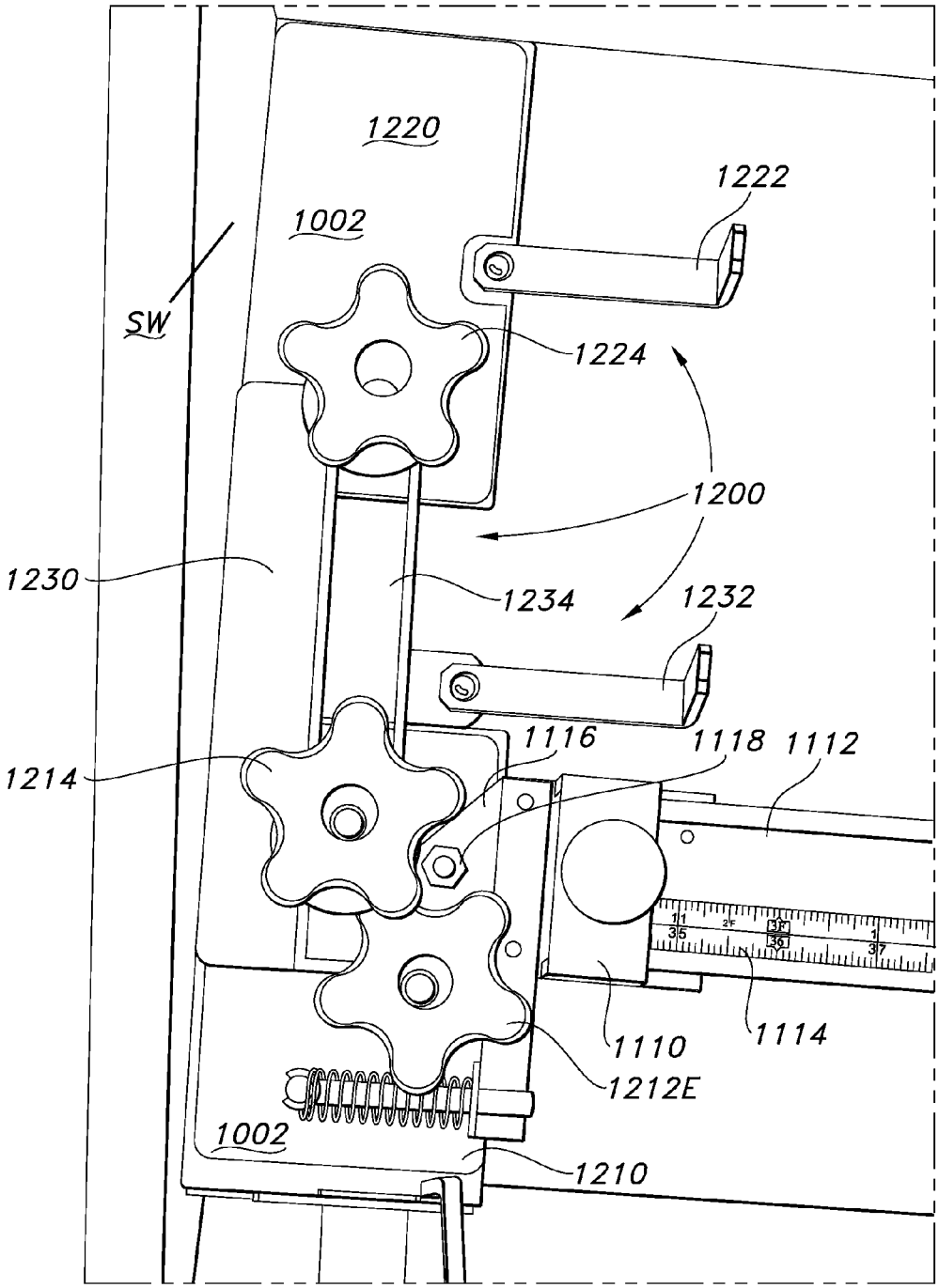
FIG. 5 is a top plan view of the sidewall adjustment assembly locked into position on a step.

FIG. 5 illustrates the sidewall adjustment assembly 1200 locked in position against a sidewall SW. This figure is not precisely a top plan view. Rather, the viewpoint is that of an installer standing in front and to the right of and looking down at the sidewall adjustment assembly 1200. The sidewall SW has a slight outward angle in the vertical and horizontal planes relative to the horizontal plane of the step and, from the viewpoint of the installer, appears to be exaggerated. The reference designation SW is placed directly on the upper surface of the sidewall and the line points to the vertical face of the sidewall. The tread-depth adjustment plate 1230 has a long open slot 1234 and is coupled to the first plate 1210 by a first coupling means 1214 that is affixed to the first plate 1210 and to the second plate 1220 by a second coupling means 1224 that is affixed to the second plate 1220. The open slot 1234 is dimensioned such, that the second plate 1220 may be extended out toward the riser R of the step, so that this second plate fits up against the sidewall SW and the riser R. For purposes of illustration, the out-of-square angle of the sidewall SW has been exaggerated, to better illustrate the function of the sidewall adjustment assembly 1200 that is able to accommodate multiple angles. The combination of the pivot pin 1118, and the first means 1212E is a two-point positioning means that allows the first plate 1210 to be securely locked into position, and once all coupling means 1214, 1224 are locked down, accurate transfer of the tread dimensions to the cutting operation is ensured. In this embodiment shown, the first and second coupling means 1212E and 1224 are star knobs, each mounted on a threaded shaft that is affixed to the respective plate 1210, 1220, although other coupling means may be used. The star knob is preferred, because the large size and the shape make the device easy to manipulate. To further facilitate ease of use of the apparatus, the height of the knobs is staggered, so that a person has sufficient room to grasp and easily and quickly manipulate each knob, without interference from adjacent knobs. The staggered heights also ensure that the plates may be moved as close to each other as possible, without one knob interfering with an adjacent knob.

The second plate 1220 and the tread-depth adjustment plate 1230 each have a manual adjustment means 1222 and 1232, respectively. This manual adjustment means 1222, 1232 is some device that allows the installer to move the respective plate into the desired position. In the embodiment shown, the manual adjustment means are simple L-brackets. It is understood, however, that small protrusions or knobs or finger depressions on the plates may serve as the manual adjustment means.

Figure 6:
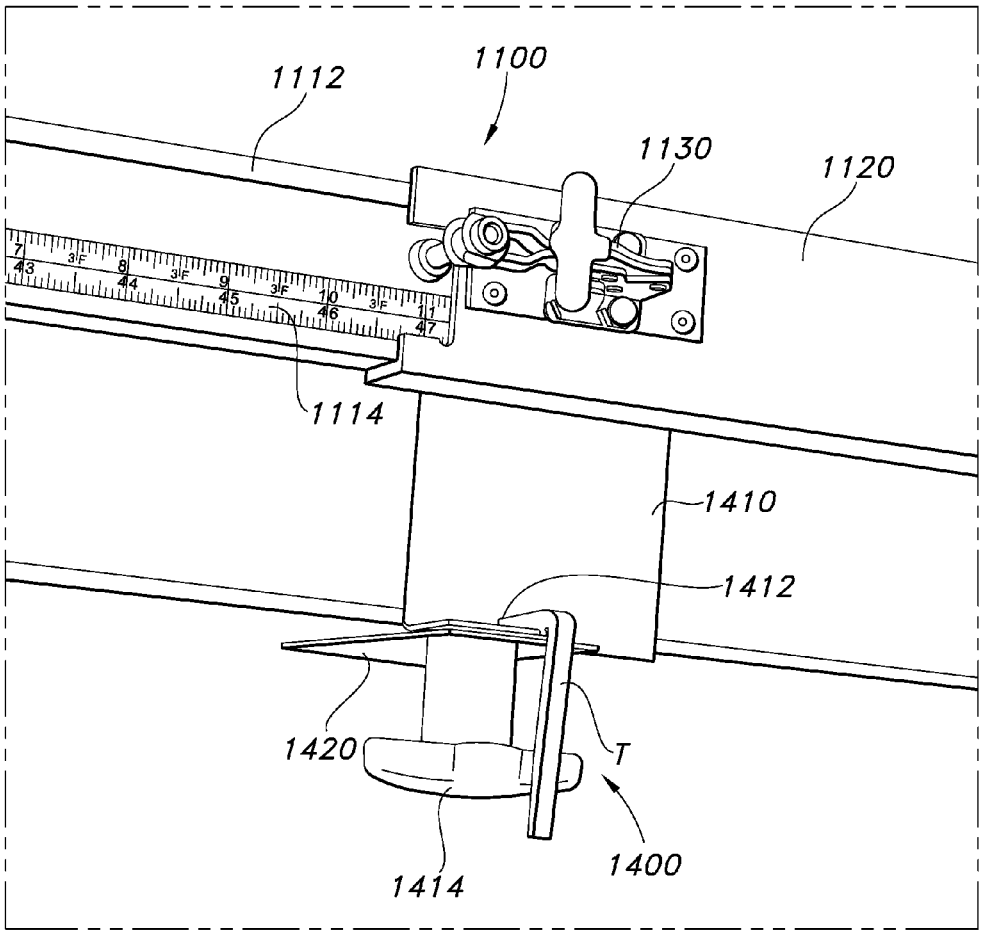
FIG. 6 illustrates a noseplate assembly attached to the extension bar.

FIG. 6 is an illustration of a noseplate assembly 1400 that is attached to the frame 1100. A base plate 1410 is rigidly affixed to the inner end of the extension bar 1120. A noseplate 1420 is coupled to the base plate 1410, so as to be adjustable over a short distance in a direction perpendicular to the axial direction of the extension bar 1120. This noseplate assembly 1400 ensures a straight alignment of the extended frame and serves as a reference point that can be repeated when the apparatus 1000 is placed on the tread material to be cut. A notch 1412 is provided in the baseplate 1410, which is adapted to receive a thickness gauge T, which is ideally a strip of material that is cut from the tread. A fastening means 1414 couples the noseplate 1420 with the base plate 1410.

Figure 7:
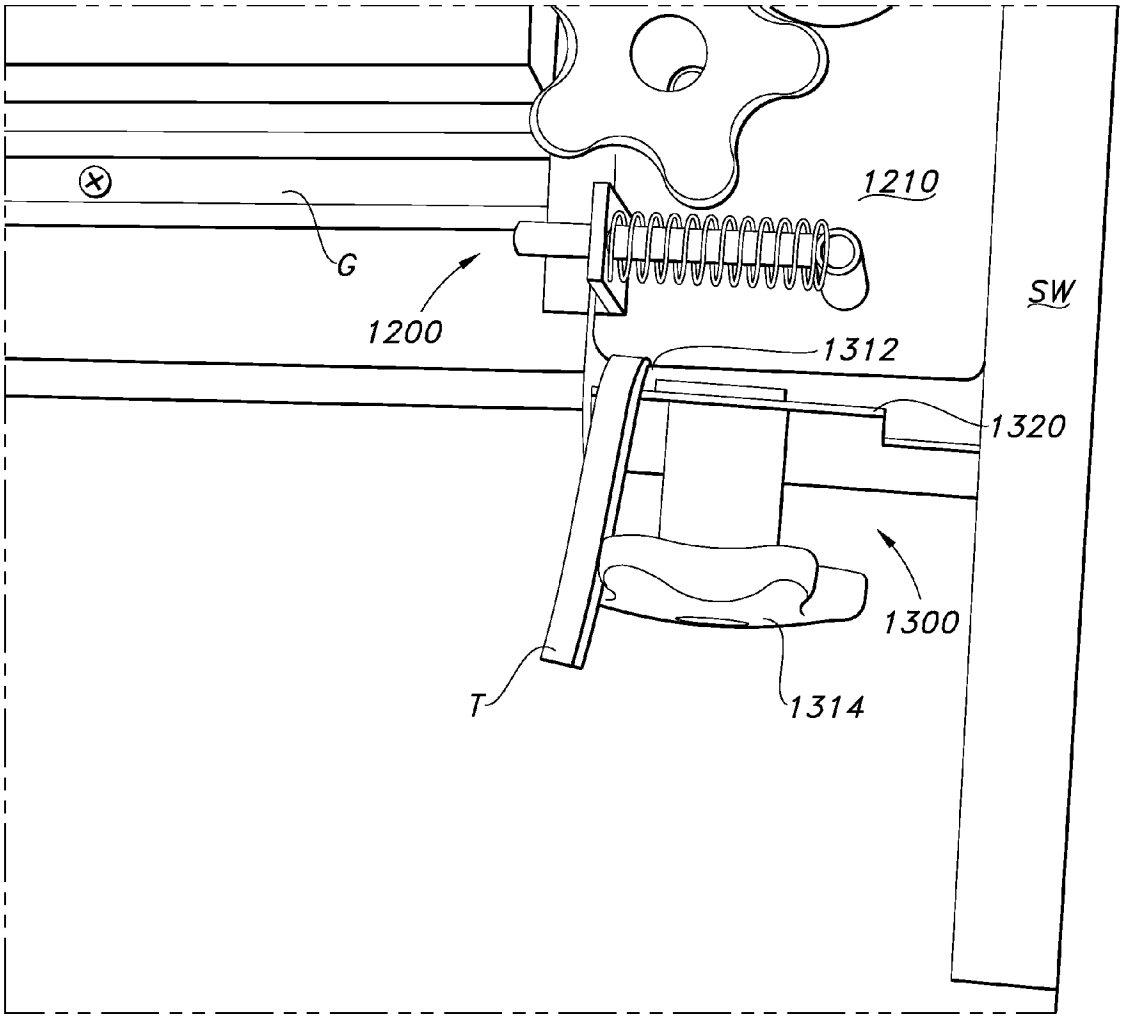
FIG. 7 illustrates a noseplate assembly attached to the sidewall adjustment assembly.
Figure 7A:
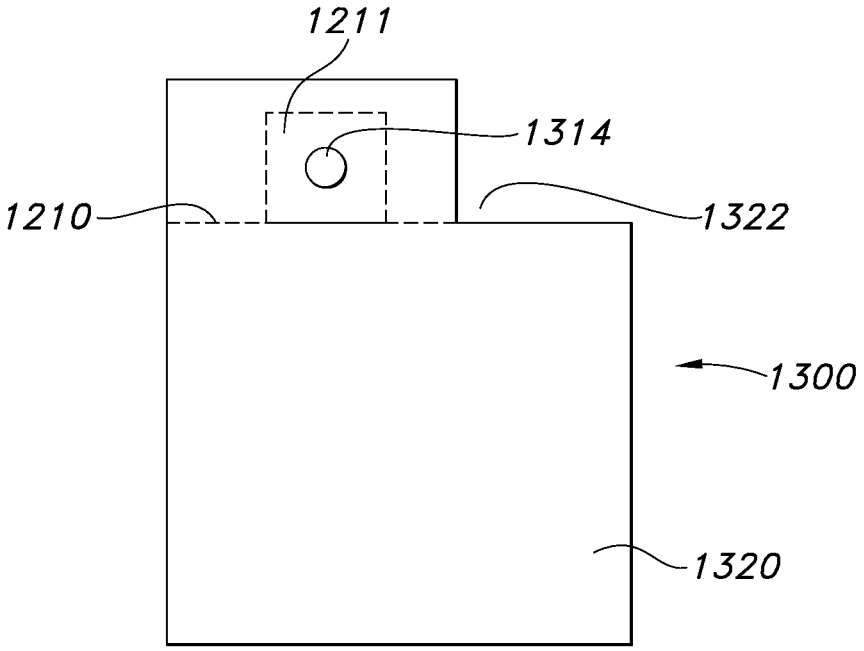
FIG. 7A is an front elevation view of a noseplate on a sidewall adjustment assembly.
Figure 8:
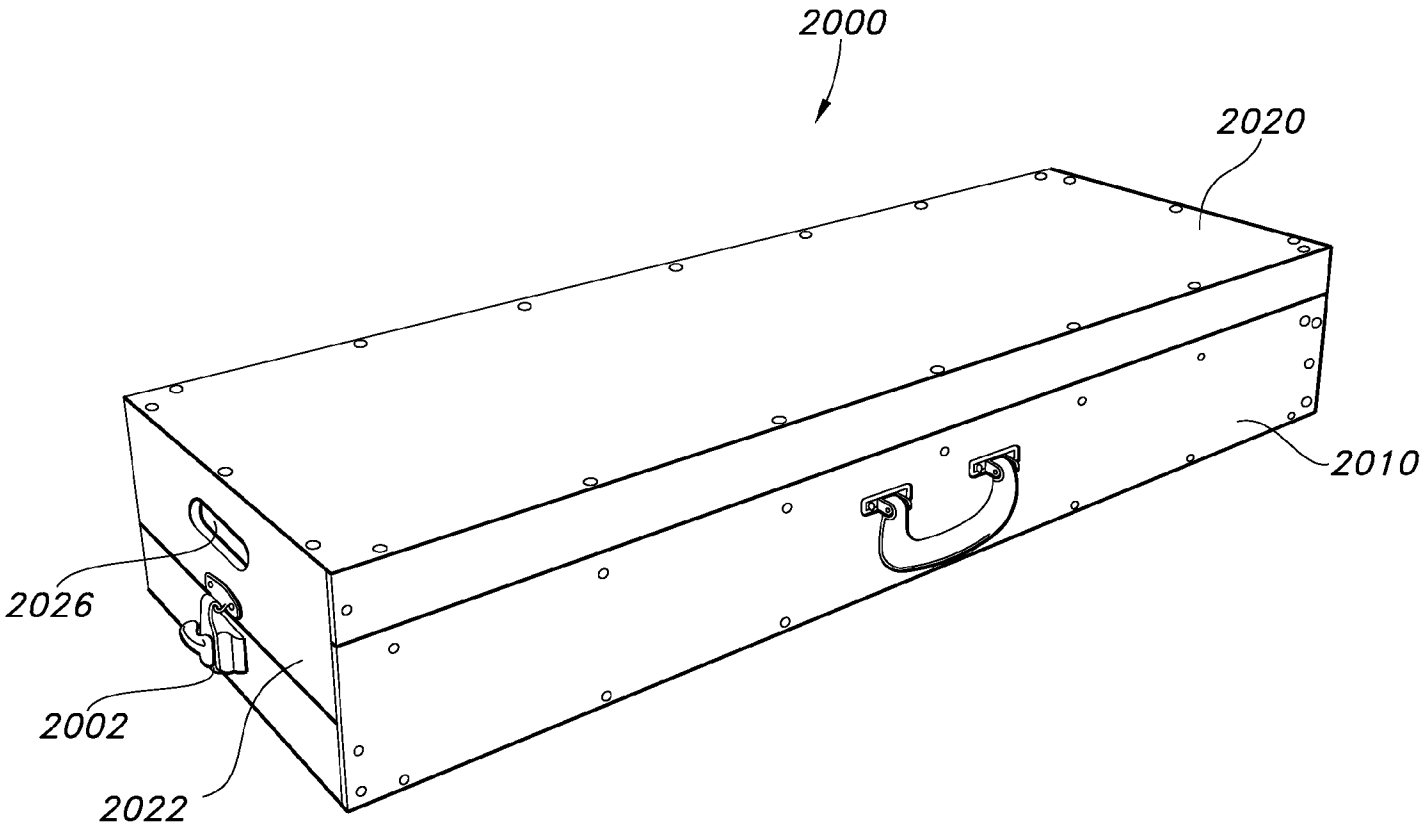
FIG. 8 is a perspective view of a closed carry case for the apparatus according to the invention.

FIG. 7 is a schematic illustration of the noseplate assembly 1300 mounted on the sidewall adjustment assembly 1200 and FIG. 7A a front elevation view of the noseplate 1320. The first plate 1210 has a flange 1211 that extends upward from the plate and serves as the anchor for the fastening means 1314. The noseplate 1320 in FIG. 7A has a cut-out 1322, for ease of use. This cut-out allows the installer to draw a knife all along the edge of the sidewall adjustment assembly 1200, to the front edge of the first plate 1210, without the fingers of the cutting hand running into the noseplate assembly 1300. Again, in this embodiment a star knob that is mounted on a threaded shaft that is attached to the flange 1211 serves as the fastening means for the noseplate assemblies, although it is understood that there are many other types of simple fasteners that may also be used for this purpose. For clarification only, inventor notes that a groove G has been cut into the ends of a demonstration step, in order to secure the sidewalls SW to the step. This groove G, shown in FIG. 7, is unrelated to the inventive apparatus.

The noseplates 1320 and 1420 are releasably coupled to the respective sidewall adjustment assemblies 1200 or base plate 1410, so that they may be easily removed when using the apparatus 1000 to cut flat sheet stock, i.e., material without a nosing.

It is suggested that a grip surface 1002 as shown in FIG. 1 be applied to the upper surfaces of the plates 1210, 1220, to the bottom surface of the tread-depth adjustment plate 1230 and to the inside surface of the noseplates 1320 and 1420, to prevent the plates from moving out of position. In the embodiment shown in FIG. 1, a fine-grit sandpaper is used as the grip surface 1002 and is adhesively applied to the various plates. It is also possible to provide a surface texture on the various plates that would improve grip, rather than using a separate grip sheet or pad.

Figure 9:
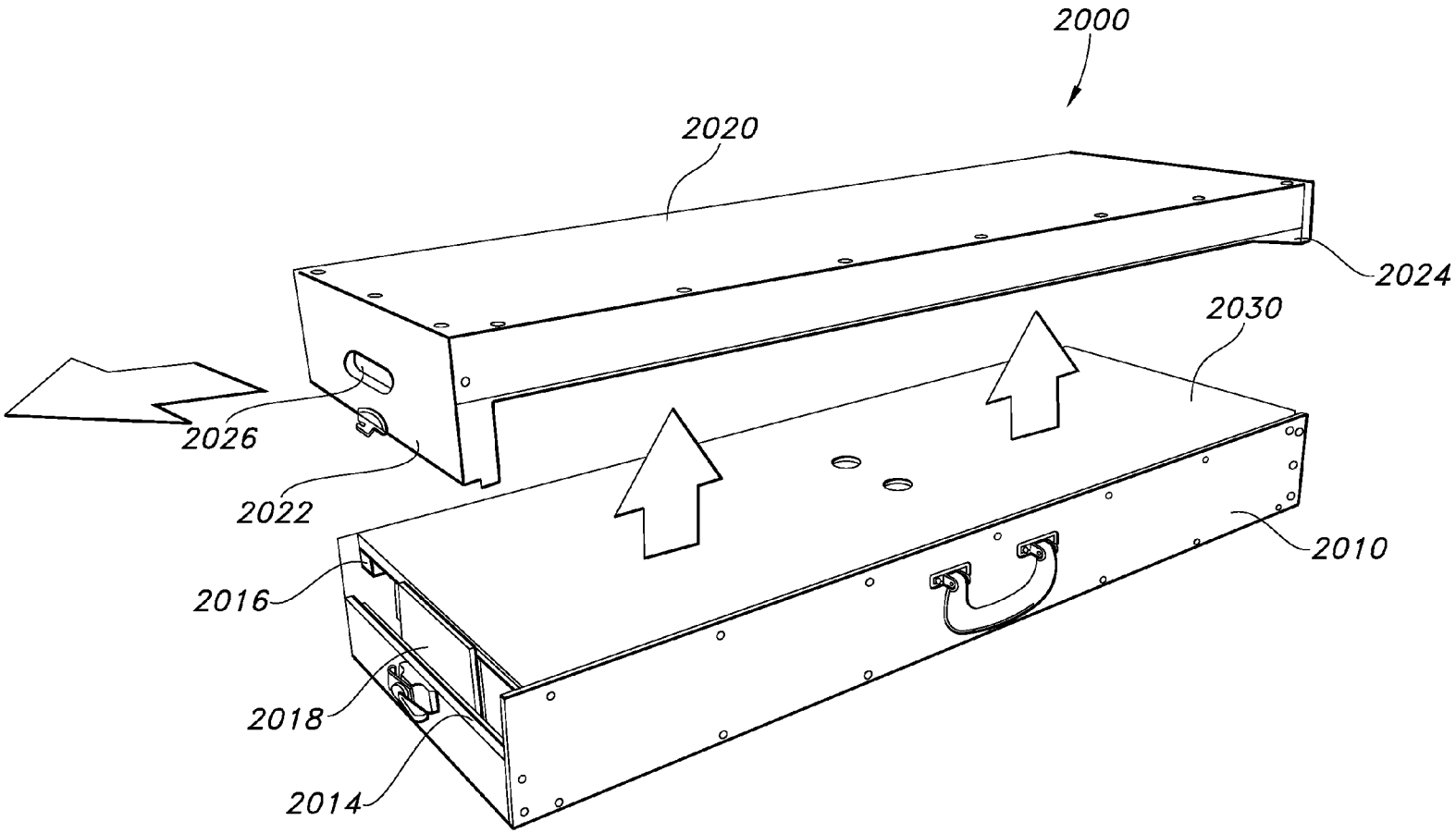
FIG. 9 illustrates the upper lid of the case being lifted off.
Figure 10:
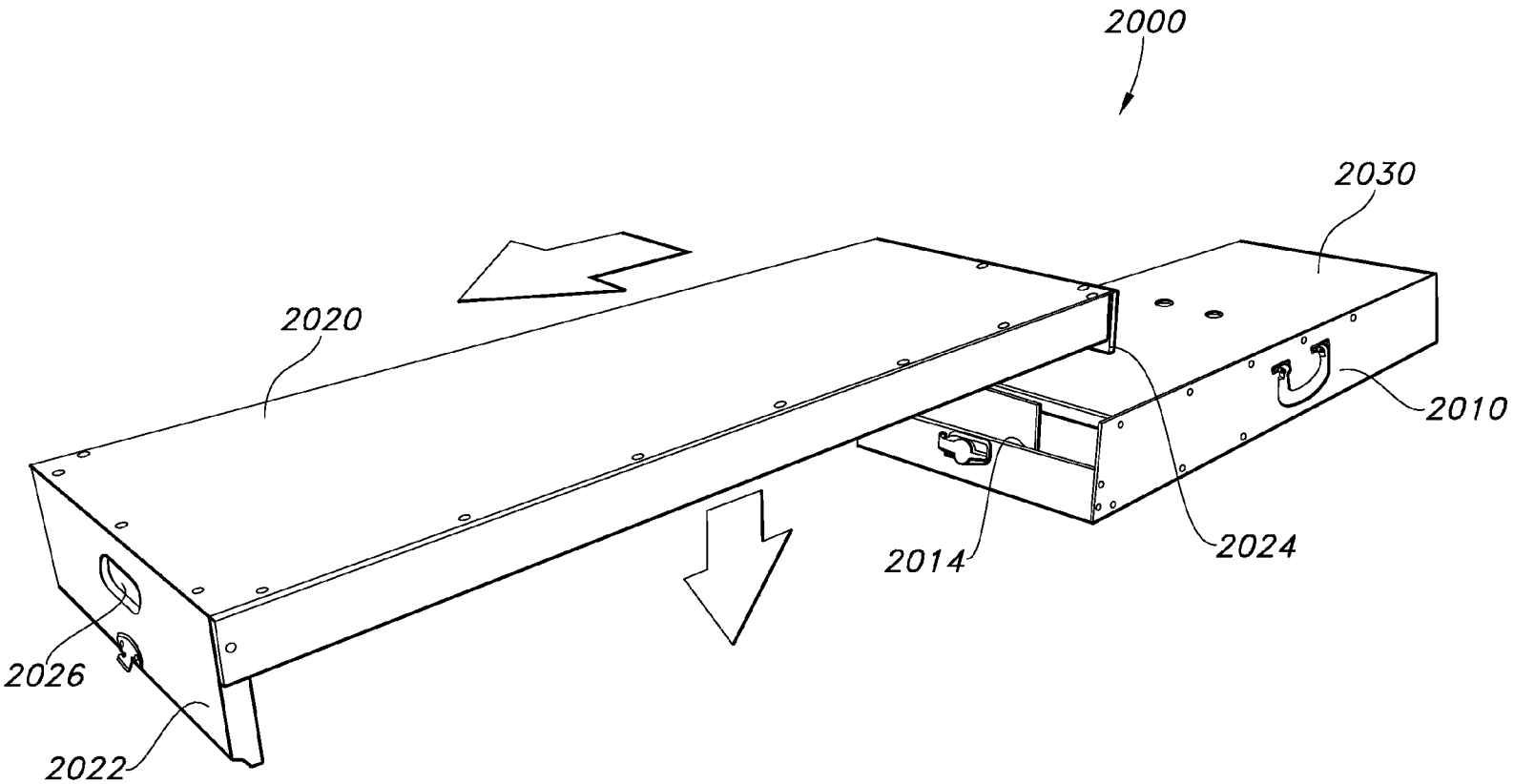
FIG. 10 shows how to connect the upper lid to the case, to form a flat cutting surface.
Figure 11:
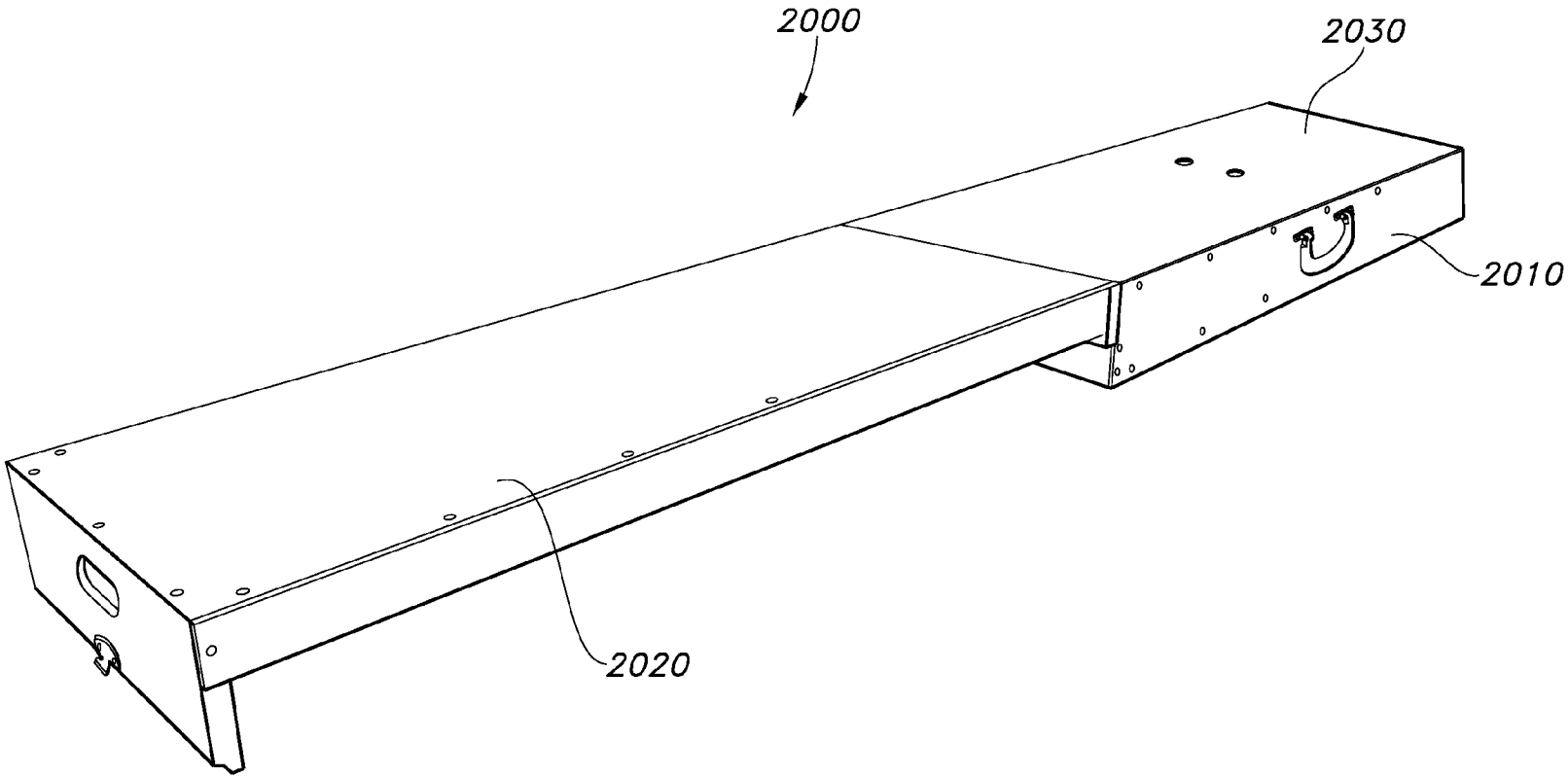
FIG. 11 shows the flat cutting surface.

FIGS. 8-11 illustrate a carrying case 2000 for the apparatus 1000, that is adapted to provide a flat surface for cutting treads. The case 2000 comprises a lower case 2010 and an upper case 2020. When closed, the upper case 2020 and lower case 2010 are securely fastened to each other with a lock or latch mechanism 2002. The upper case 2020 has hand grips 2026 formed into its two ends to facilitate lifting it completely off the lower case 2010. As best seen in FIG. 9, the upper case 2020 has a support end 2022 and a coupling end 2024. The support end 2022 is dimensioned such, that it corresponds in height to the height of the lower case 2010, whereas the coupling end 2024 is shorter. The lower case 2010 has a first end 2014, which is adapted to receive the coupling end 2024 of the upper case 2020. The lower case has an inner wall 2018 at the first end, that is offset inward to accommodate the coupling end 2024 of the upper case. A flange 2016 extends around the other three sides of the lower case 2010, close to the top of the case. A plate 2030 fits over the top of the lower case 2010, supported by the flange 2016 and the inner wall 2018. The coupling end 2024 of the upper case 2020 is fitted into the first end 2014 on the lower case 2010. Together, the lower case 2010 with the plate 2030 and the upper case 2020 form a long flat surface that is ideal for cutting treads. Any suitable material for the case may be used, but preferably, the material will allow one to cut the tread material on it without dulling the knife.

Figure 12:
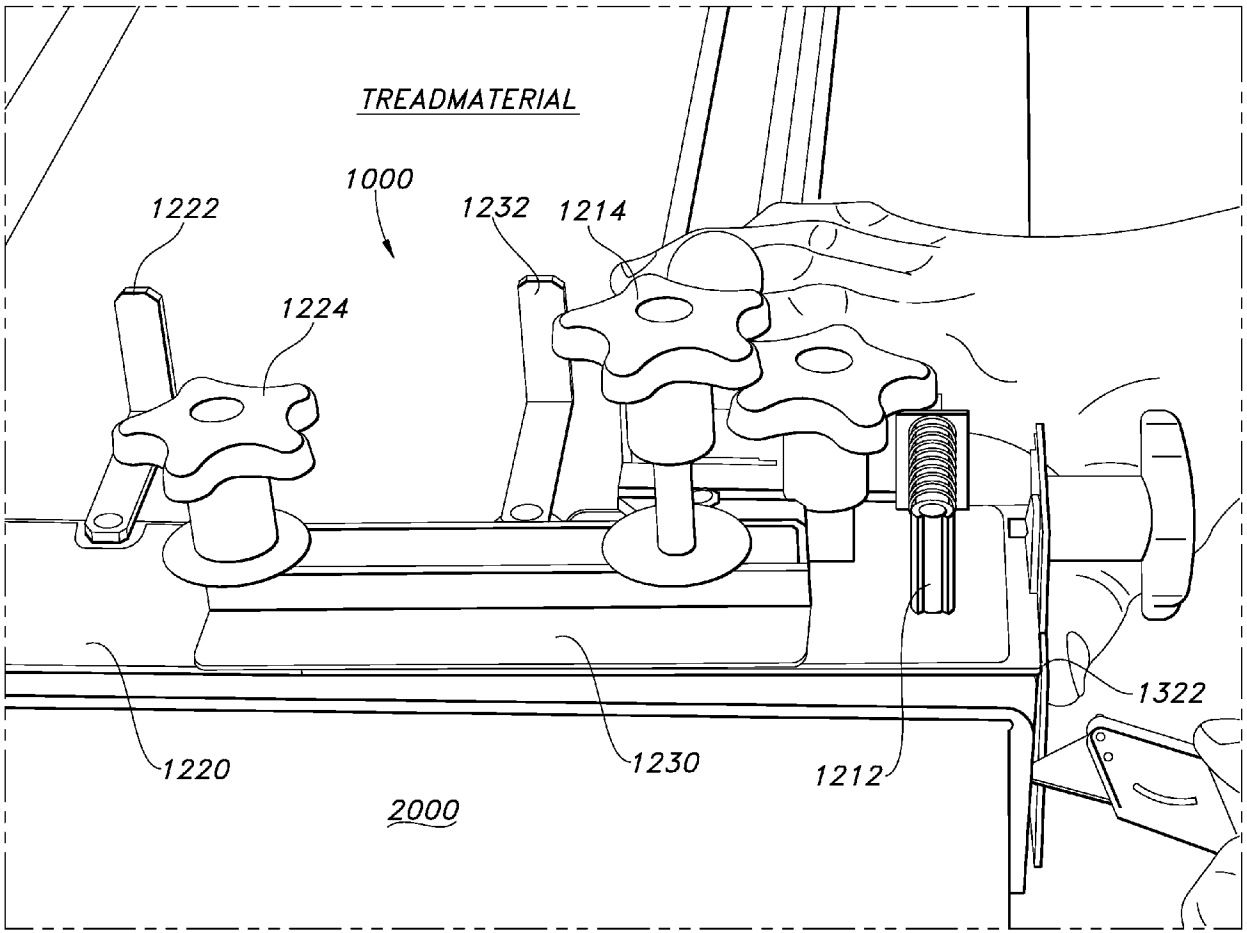
FIG. 12 shows the apparatus according to the invention placed on tread material on a cutting surface.

FIG. 12 is a partial view of the apparatus 1000 placed on top of tread material on a cutting surface. This figure shows a slightly uneven line for the sidewall and the unobstructed path for cutting the tread material from the riser edge R across the tread portion and down across the nosing of the tread material.

Operation:

The installer places the apparatus 1000 on a step, pulls out the extension bar 1100 until the first plate 1210 of the sidewall adjustment assembly 1200 at each end bumps up against the respective sidewall. Ideally, the thickness gauge T is placed in the notch 1312 of the noseplate assemblies 1300 and 1400. The apparatus 1000 is then pushed toward the back of the step until the nose plates 1320/1420 touch the front edge of the step. The noseplate assembles 1300 and 1400 are then secured in position by tightening the fastening means 1314 and 1414 The installer then adjusts each plate 1210, 1220, 1230 of the sidewall adjustment assemblies 1200, so that the plates touch the sidewalls and the second plate 1220 is moved to the back of the step until it is also in contact with the riser R. All coupling means for the sidewall adjustment assemblies are then tightened, to lock the plates in position.

The installer then notes how far the extension bar 1120 has been pulled out by checking the measurement means 1114. The extension bar 1120 may now be pushed over the slider base 1110 and the complete apparatus 1000 lifted off the step. The noseplate assemblies 1300 and 1400 and the sidewall adjustment assemblies 1200 remain locked in position. The apparatus 1000 is then placed on a cutting surface.

The carrying case 2000 provides an ideal surface for cutting the tread material, because it has sufficient width and length to accommodate the dimensions of most staircases in residential and commercial buildings. If not done so at the beginning, when the apparatus 1000 was removed from the case, the installer now fits the upper case 2020 onto the lower case 2010 and places the inner plate 2030 over the lower case to create a flat cutting surface. The material that is to be cut for the tread is placed on this cutting surface, with the lip of the material extending down over the front edge of the cutting surface.

The apparatus 1000 is now placed on the tread material on the cutting surface, the extension bar 1120 pulled out to the length that was previously noted, and the frame lock applied 1130. The frame 1100 is positioned on the material such, that the noseplate assemblies 1300 and 1400 bump up against the lip of the tread material. This time, though, the thickness gauge T is removed from the notches 1312 and 1412. The apparatus 1000 is now in position for the installer to cut the tread. With an appropriate tool, such as a utility knife, the installer cuts the material, closely following the contours provided by the outer edges of the sidewall adjustment assemblies 1200. The cut-out 1332 in the nose plates 1320 at the sidewall adjustment assemblies allows the installer to easily cut the material all the way to the front edge and down over the lip or nosing, without interference from the nose plate 1320. To finish cutting the tread, the installer uses a conventional straight edge to cut across the riser edge N, i.e., the back edge of the tread that fits up against the step riser, using the back edge of the second plates 1220 as a guide. The finished product is a tread that precisely matches the shape of the step and therefore lies flat and leaves no gaps between the sidewall and tread and riser and tread.

The specific materials used to construct the apparatus are governed by the degree of ruggedness and ease of use that are desired. In the embodiment constructed by the inventor, the plates of the sidewall adjustment assemblies, for example, are rugged steel plates. The fixed end of the frame 1110 and the extension bar 1120 are constructed of metal, such as steel or aluminum. To ensure that the extension bar 1120 and slider base 1112 function properly, i.e., without binding, the slider base 1112 is constructed of high-density PE (HDPE) plastic. This ensures that the sliding function of the two parts is not influenced by temperature and humidity. All couplers and fasteners that need to be manipulated by the installer are of a type that is easy and quick to use, even for persons with large hands. In the embodiment shown in FIG. 1, three five-point star knobs are used on each sidewall adjustment assembly. The heights of the knobs are staggered, so that each knob can be quickly and easily manipulated and to prevent interference with an adjacent knob when the plates are moved as close together as possible.

It is understood that the embodiments described herein are merely illustrative of the present invention. Variations in the construction of the tread measuring and cutting apparatus according to the invention may be contemplated by one skilled in the art without limiting the intended scope of the invention herein disclosed and as defined by the following claims.

What is claimed is:

1. An apparatus for measuring and cutting a material to correspond to dimensions of an object having a sidewall, the apparatus comprising:

a length-adjustable frame having a slider base and an extension bar that is slidable along the slider base to selectively extend and shorten a length of the length-adjustable frame;

a measurement means provided on the length-adjustable frame;

a sidewall adjustment assembly coupled to an end of the length-adjustable frame, the sidewall adjustment assembly including at least two sidewall adjustment plates and each sidewall adjustment plate having an outer edge that accommodates a contour of the sidewall of the object; and a noseplate assembly coupled to the sidewall adjustment assembly;

wherein the length-adjustable frame is extendable to a width of the object and the measurement means indicates a position of the extension bar on the slider base;

wherein the sidewall adjustment assembly is adjustable to correspond to a side contour of a vertical sidewall of the object, including a sidewall with a contour that is not a straight line, bordering the object and a depth of the object and fixable to a corresponding position; and wherein the noseplate assembly is adjustable and fixable to a position that accommodates a thickness of the material.

2. The apparatus of claim 1, wherein the sidewall adjustment assembly includes two or more sidewall adjustment plates that are movably coupled to each other, and wherein a tightening means is provided on each one of the two or more sidewall adjustment plates, so as to allow tightening of the each one of the plates to a particular position.

3. The apparatus of claim 2, wherein the tightening means includes a plurality of five-point star knobs.

4. The apparatus of claim 2, wherein the two or more sidewall adjustment plates includes a first sidewall plate that is pivotably coupled to an end of the length-adjustable frame, wherein the end of the length-adjustable frame includes an adjustment slot in which the tightening means for the first sidewall plate is captured, so as to allow the first sidewall plate to be moved to a position that accommodates an out-of-square alignment of the sidewall.

5. The apparatus of claim 4, wherein the first sidewall plate is pivotably coupled to an end of the length-adjustable frame and is spring-biased to a position that forces a front end of the first sidewall plate outward toward a sidewall, thereby automatically capturing a contour of the sidewall without manual adjustment by an installer.

6. The apparatus of claim 1, wherein the noseplate assembly includes a noseplate that is coupled to the sidewall adjustment assembly with an adjustable knob and depends downward from the sidewall adjustment assembly along a front face of the object, and wherein the noseplate has a cutout to facilitate cutting the material without interference from the noseplate.

7. The apparatus of claim 1, wherein the sidewall adjustment assembly has an anti-slip device to facilitate fixing the sidewall adjustment assembly in position.

8. The apparatus of claim 7, wherein the anti-slip device is a sheet of sandpaper adhesively attached to an undersurface of each plate in each assembly.

9. The apparatus of claim 1, wherein the length-adjustable frame includes a mechanical lock to lock the extension bar to a particular on the slider bar.

10. The apparatus of claim 1, wherein the measurement means is a measuring tape affixed to the slider base.

11. The apparatus of claim 1, wherein the sidewall adjustment assembly includes a first sidewall plate, a second sidewall plate, and a depth-adjustment plate that is movably coupled to the first and second sidewall plates, so as to enable adjustment of the sidewall adjustment assembly to correspond to a depth of the object, wherein the depth-adjustment plate has an outer edge that accommodates a contour of the sidewall of the object.

12. The apparatus of claim 11, wherein the depth-adjustment plate is pivotably coupled to the first sidewall plate by a tightening means that allows the depth-adjustment plate to be fixed to a particular position relative to the first sidewall plate.

13. The apparatus of claim 12, wherein the depth-adjustment plate has an slot in which the tightening means of the second sidewall plate is captured, and wherein the second sidewall plate is translatably movable relative to a position of the first sidewall plate by moving the tightening means of the second sidewall plate along the slot to a desired position and then tightening the tightening means to secure the second sidewall plate to the desired position.

14. The apparatus of claim 1, wherein the sidewall adjustment assembly includes manual gripping means for manually moving one or more of the at least two sidewall adjustment plates into a desired position.

* * * * *